United States Patent [19]

Takagi

[11] 4,172,174

[45] Oct. 23, 1979

[54] CUSHIONING MATERIAL AND PROCESS FOR PREPARING THE SAME

[76] Inventor: Sadaaki Takagi, 39, Mikage-cho, Okazaki-shi, Aichi-ken, Japan

[21] Appl. No.: 900,349

[22] Filed: Apr. 27, 1978

[30] Foreign Application Priority Data

| | | | |
|---|---|---|---|
| Apr. 30, 1977 | [JP] | Japan | 52-50934 |
| Sep. 12, 1977 | [JP] | Japan | 52-109736 |
| Sep. 12, 1977 | [JP] | Japan | 52-109737 |
| Apr. 17, 1978 | [JP] | Japan | 53-44293 |

[51] Int. Cl.[2] ..... D04H 1/48

[52] U.S. Cl. ..... 428/288; 5/461; 5/464; 156/62.4; 156/148; 156/181; 156/296; 428/300; 428/301; 428/303; 428/362; 428/369; 428/371; 428/392

[58] Field of Search ..... 428/288, 290, 297, 299, 428/300, 301, 362, 369, 370, 371, 302, 303, 392; 156/62.4, 148, 181, 296; 5/355, 361

[56] References Cited

U.S. PATENT DOCUMENTS

| | | | |
|---|---|---|---|
| 2,978,785 | 4/1961 | Wenzell et al. | 428/369 |
| 3,071,783 | 1/1963 | Gamble | 428/369 |
| 3,413,179 | 11/1968 | Goy et al. | 428/301 |
| 3,595,738 | 7/1971 | Clarke et al. | 428/362 |
| 3,852,152 | 12/1974 | Werner et al. | 428/371 |
| 3,929,542 | 12/1975 | Gehrig et al. | 428/371 |

*Primary Examiner*—James J. Bell

*Attorney, Agent, or Firm*—Gordon W. Hueschen

[57] ABSTRACT

A cushioning material composed of a drafted three-dimentionally crimped filament mass of a synthetic fiber by bonding contact points between each of the filament with an adhesive, wherein the filament crimped in various shapes formed by partially expanding and compressing the filament crimps at required specific portions in the cushioning material with directionality in required specific directions are distributed with partially increased density in the degree of entanglement.

34 Claims, 19 Drawing Figures

Figure 1:
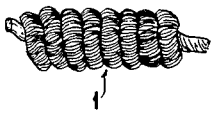

LOAD (g/cm²)
600
500
400
300
200
100
0
10
20
30
40
50
60
70
80
%
STRAIN (%)
D
C
B
E
A

LOAD (g/cm²)
450
400
350
300
250
200
150
100
50
0
10
20
30
40
50
60
70
80
%
STRAIN (%)
I
H
G
J
F

CUSHIONING MATERIAL AND PROCESS FOR PREPARING THE SAME

The present invention relates to a cushioning material comprising a filament mass of synthetic fiber having three-dimensional crimps and a process for preparing the same. mass of I have found that a cushioning material produced from a filament mass having three-dimensional crimps by a process comprising cutting them to a predetermined size, drafting them, thereafter, compressing molding them while opening and then bonding the contact points between each of the filaments by an adhesive is highly resilient, air-permeable and excellent in cushioning properties. The above cushioning material, however, lacks in desired strength for compression load, in particular, selective load strength in predetermined portions and in required specific directions although it is resilient and air-permeable. More specifically, it is required for the above cushioning material to increase the filament denier or the density in the molded filament mass or to increase amounts of adhesives used in order to attain a desired load strength, but it fails to give a sufficient compression resilience that is the most important factor in the cushioning material, and no required resilience can thereby be obtained.

In conventional seats for automobiles and aircrafts, as well as for furniture chairs, loads exerted on them upon sitting are not uniform but usually vary depending on the body configuration or contour of a sitter. By the way, since the cushioning material used for the seats such as fibrous materials, for example, straw, jute and coir fiber, combination of these materials with springs, or foam materials, for example, foamed rubber and polyurethane foam are uniform in their constitution, it is impossible to provide a required compression resilience to predetermined portions. In addition, since the fibrous materials have been filled within spaces defined with stitching, mass production of cushioning material having required compression resilience at predetermined portions is impossible. Namely, it has heretofore been impossible to produce individually or continuously those cushioning material having desired cushioning properties (compression resilience) and softness in combination.

Accordingly, it is an object of the present invention to provide a cushioning material of excellent cushioning property, as well as provide a process for preparing the same.

Another object of the present invention is to provide a cushioning material having compression resilience which varies depending on portions, as well as to provide a process for preparing the same.

A still another object of the present invention is to provide a continuous production process for such cushioning material.

A further object of the present invention is to provide a cushioning material for seats, as well as provide a process for preparing the same.

These and other objects of the present invention can be attained by a cushioning material composed of a drafted three-dimensionally crimped filament mass of a synthetic fiber by bonding contact points between each of the filament with an adhesive, wherein the filament crimped in various shapes formed by partially expanding and compressing the filament crimps at required specific portions in the cushioning material with directionality in required specific directions are distributed with partially increased density in the degree of entanglement. The above cushioning material can be prepared by a process comprising the steps of opening a drafted three-dimensionally crimped filament mass, molding it to a predetermined configuration, sticking the molded body of the three-dimensionally crimped filament mass thus molded at required specific portions at least from one of the required specific directions along which the load strength is intended to be increased by using needles each having barbs at its tip at a predetermined sticking density for a predetermined number of times and bonding the contact points between each of the crimped filaments constituting the above molded body with an adhesive.

Figure 2:
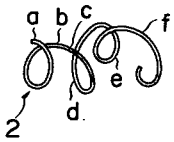
Figure 3:
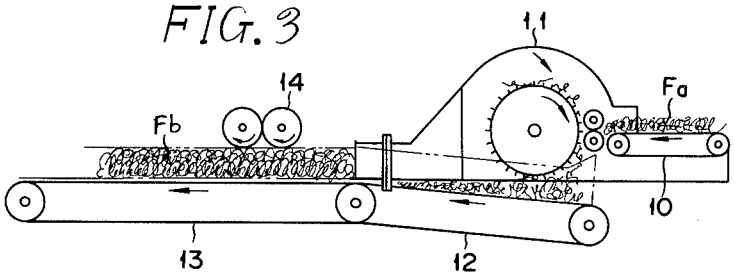
Figure 4:
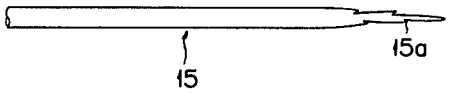
Figure 6:
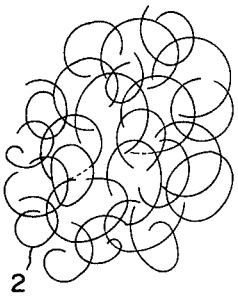
Figure 7:
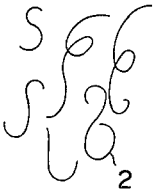
Figure 8:
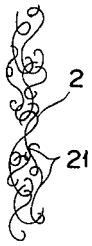
Figure 5:
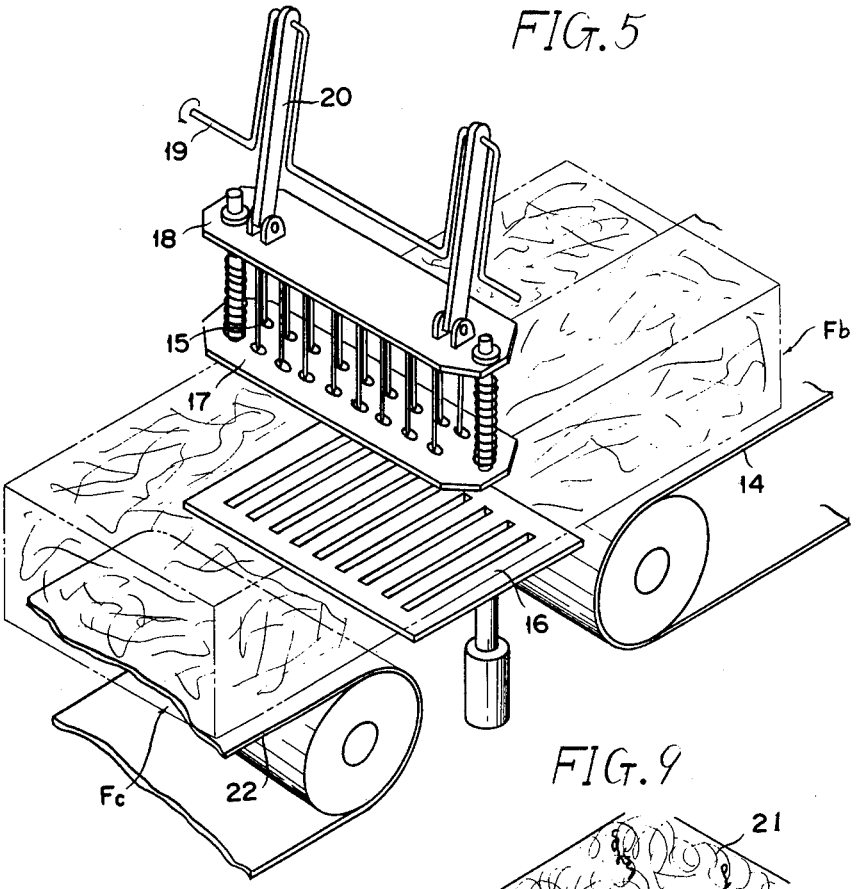
Figure 9:
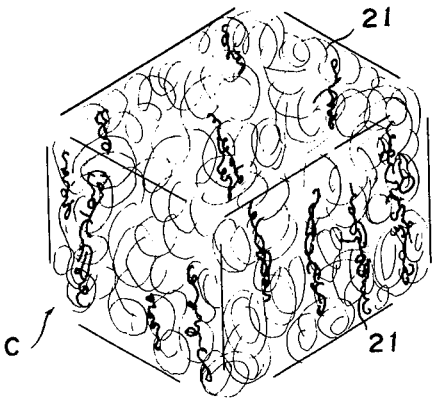
Figure 10:
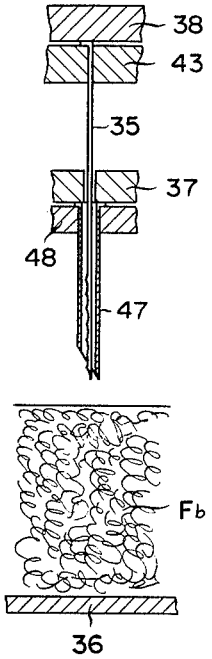
Figure 11:
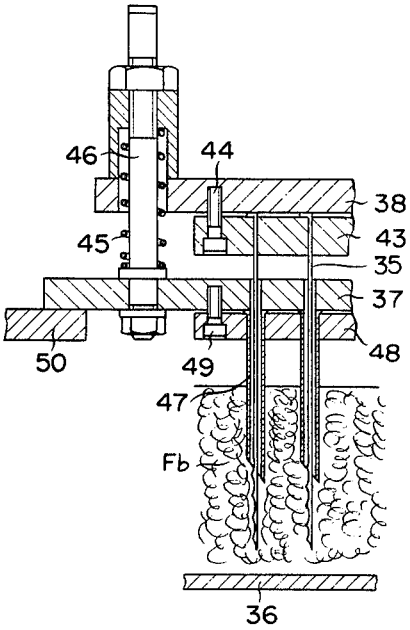
Figure 12:
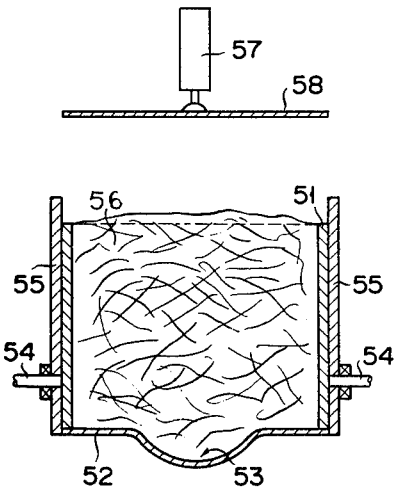
Figure 13:
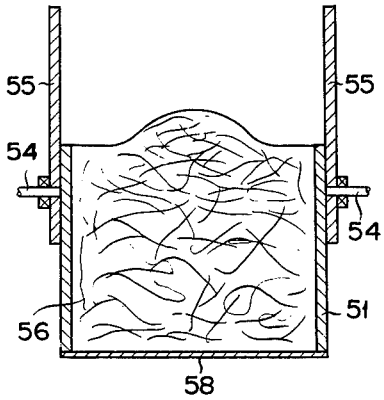
Figure 14:
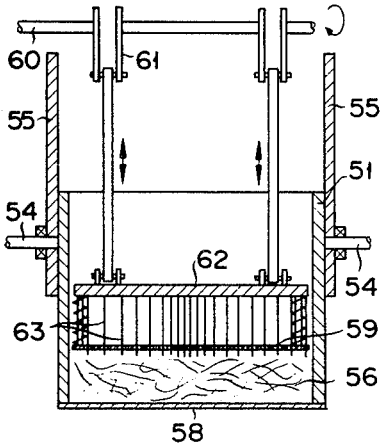
Figure 18:
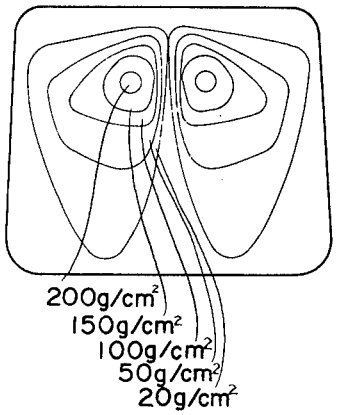
Figure 15:
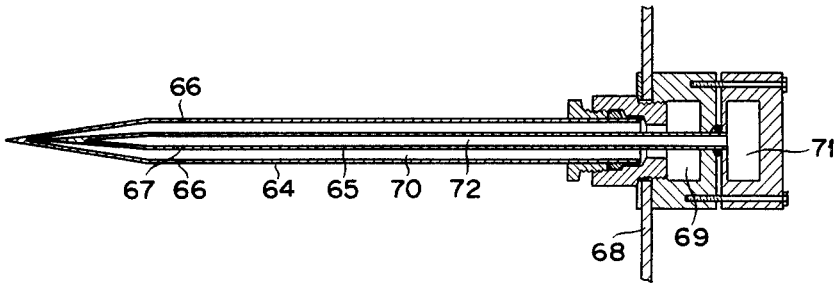
Figure 19:
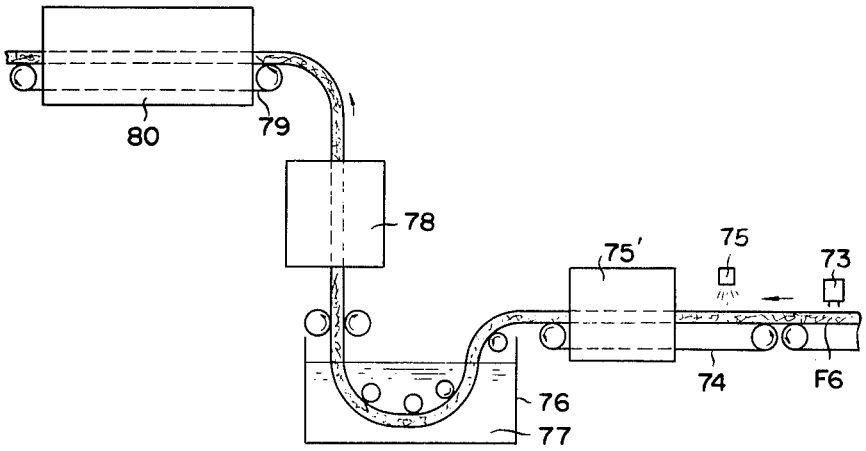
Figure 16:
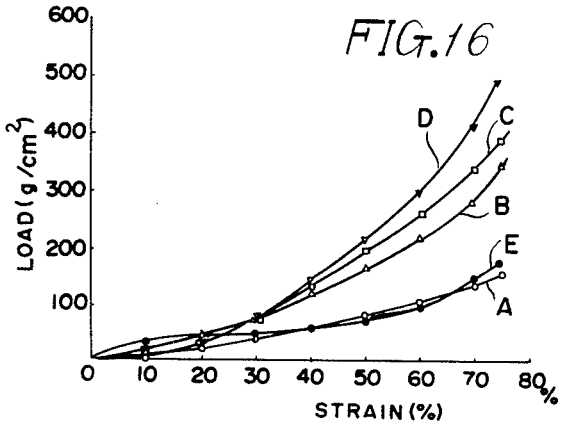
Figure 17:
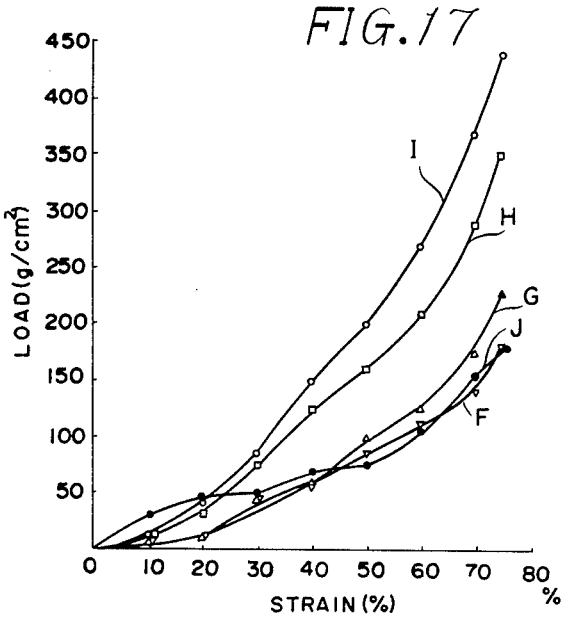

The present invention will be understood best in connection with the accompanying drawings wherein;

FIG. 1 is a partial perspective view of a double crimped filament,

FIG. 2 is a front view of a three-dimensionally crimped three-oriented filament, FIG. 3 is a schematic view of an apparatus for the compression molding of three-dimensionally crimped filament mass, FIG. 4 is a perspective view of a needle used in the process of the present invention, FIG. 5 is a perspective view of a needling device, FIG. 6 is a perspective view of the filament mass prior to the needling, FIG. 7 is a perspective view of each of the filaments deformed by needling;

FIG. 8 is a principle perspective view showing filaments entangled in one direction, FIG. 9 is a perspective view of cushioning material according to the present invention, FIG. 10 is a cross sectional view for the outline of an apparatus used for the production of the cushioning material in accordance with an another embodiment of the present invention in the state during elevation of the needle, FIG. 11 is a cross sectional view for the apparatus shown in FIG. 10 in the state during lowering of the needle, FIGS. 12 to 14 are schematic cross sectional views for the main parts of the production step of the cushioning material used for seats, FIG. 15 is a cross sectional view showing one embodiment of a needle-like spray;

FIGS. 16 and 17 are graphs showing relations between the load and the strain in the cushioning material, FIG. 18 is a chart for showing the distribution of the compression resilience in the cushioning material for seats, and FIG. 19 is a cross sectional view for the outline of an apparatus used for the production of the cushioning material in accordance with further embodiment.

The synthetic fiber usable herein includes polyester, polyamide, polypropylene and the like, polyester being most preferred. The fiber is, desirably, of three-dimensionally crimped synthetic fiber in a denier between 30–1000 d, preferably, 50–600 d and the most preferably, 100–500 d as a monofilament. The three-dimensional crimps means herein those crimps in the widest meanings including three-dimensionally oriented, as well as two-dimensionally oriented crimped filaments. The three-dimensionally three-oriented crimped filament is preferably used. The three-dimensionally three-oriented crimped filament can be obtained, for example, by preparing a heat-set double twisted filament as shown in FIG. 1 by a device disclosed in U.S. Pat. application Ser. No. 799,180 by me and untwisting the same as shown in FIG. 2. Thus, the part of the filment at a coils over the part at b. The part at c coils over the part at d. However, the part at a e does not coil over the part at f but coils under it. Thus, the section of filament from e to d is under two bites or coils of the helix. This is what may properly be called a disoriented helix and is very much like a helical telephone cord which gets out of whack when one of the coils thereof becomes disoriented with respect to the others. The length of filament after drafting is preferably between 40–200 mm and, more preferably, 60–150 mm.

Production of the cushioning material is conducted in the following sequence. As shown in FIG. 3, mass Fa of the drafted three-dimensionally three-oriented crimped filament mass F of larger denier synthetic fiber is fed by way of a belt conveyor 10 to an opener 11 and enforced between the belt conveyors 12 and 13 and a rotating drum 14 by means of air flowing and the like while opening the mass, where it is compression molded into a predetermined configuration.

The mass Fb of the compression molded filament then has a sufficient space for deflection and a bulk density of between 0.005–0.1 g/cm$^3$, preferably, between 0.01–0.05 g/cm$^3$.

Then, the filament mass Fb thus compression molded is needle punched or needled at required specific portions with needles 15 having at least one barb 15*a* at the tip as shown in FIG. 4 at an appropriate needle density for appropriate number of times while supporting the mass at the surface opposing to the required specific direction along which a predetermined strength for load is to be increased by a flat plate, such as a perforated plate, a slit plate and the like. The diameter and the length of the needle 15 are determined depending on the purpose as usually of 1.8–3.6 mm of diameter and 50–1000 mm of length and one needle usually has 4–12 barbs. In a specific embodiment for example shown in FIG. 5, the filament mass Fb compression molded and transferred on a belt conveyor 13 is subjected to needling while supported at its lower surface by a flat plate 16 such as a perforated plate, a slit plate, a slit belt conveyor by needles 15 at an appropriate sticking density with or without intervening an apertured plate such as a perforated plate and a slit plate from the opposing surface of the molded filament boby Fb by the vertical movement of a needle fixture 18. The needles 15 are mounted in one or more rows and at a desired pitch to the needle fixture 18 which is caused to move by the rotation of a crank shaft 19 thereby causing a crank 20 connecting the shaft 19 and the fixture 18 to operate. Meanwhile, the molded filament body Fb is sent at such a speed as to provide an appropriate needling interval. The density of the needling is varied depending on the application uses and the compression resilience desired in a final cushion product and the needle density is increased, that is, the needle pitch is reduced where higher compression resilience is desired. Usually, the needle density is between 1–100 needles/100cm$^2$, preferably between 4–50 needles/100cm$^2$.

While in the above embodiment, explanation has been made for vertical sticking over the entire surface on one side, sticking can of course be made vertically on both sides, slantwise, traversely and the like.

By sticking the molded filament body at predetermined portions in predetermined directions by the needles 15, randomly-oriented ring-shaped three-dimensional crimps in the staple filaments 2 as shown in FIG. 6 are expanded or compressed in the sticking directions into S-, L-, J-, 3- and corrugated shapes as shown in FIG. 7, whereby the three-dimensional crimps in the filaments 2 partially entangle to each other in the foregoing various shapes to remarkably increase the degree of the entanglement as compared with other portions as shown in FIG. 8. Consequently, distribution of the contact points 21 is more dense in the sticking directions by the needles 15. It is considered that such a proper arrangement of the portions having directionality and those not having directionality (ring-shaped portions) of the three-dimensional crimps and the distribution of the contact points can provide the cushioning materials with desired load strength properties at predetermined portions in the predetermined directions. The bulk density in the molded filament block Fc is usually between 0.005–0.1 g/cm$^3$, preferably, 0.01–0.05 g/cm$^3$.

Then, the molded filament body Fc thus needled is transferred by means of a belt conveyor 22 to the succeeding bonding step where the contact points between each of the three-dimensionally crimped filament 2 present initially, as well as those formed in the needling step are bonded by an adhesive, to obtain cushioning material C as shown in FIG. 9. Amount of the adhesive to be applied is usually between 10–200 g/100g filament, preferably, 50–120 g/100g filament, as solid content. The bulk density of the cushioning material C according to the present invention thus prepared is 0.01–0.2 g/cm$^3$, preferably 0.03–0.12 g/cm$^3$.

The bonding treatment for the three-dimensionally crimped molded filament body Fc thus needled is effected by spraying the adhesive from above, spraying the adhesive to the inside of the molded body Fc using a needle sprayer as described later or by immersing the molded filament body Fc in an adhesive solution and then drying or vulcanizing the body by heating at a temperature of 80°–200° C., preferably, 100°–150° C. for 10–60 minutes, preferably 15–40 minutes.

The typical adhesive used herein includes a synthetic rubber adhesive such as styrene-butadiene rubber, acrylonitrilbutadiene rubber, chloropren rubber, urethane, rubber, etc.; natural rubber; a vinylic adhesive; vinyl acetate adhesive; cellulose acetate adhesive; acrylic adhesives and the like, and they are used in the form of a latex or a solution.

While the foregoing adhesive can be used along or in combination, a better result can be obtained by bonding the filament to each other initially by the synthetic rubber adhesive and then treating the same with the natural rubber adhesive. The initial bonding for the contact points between each of the filament by the synthetic rubber adhesive having satisfactory bondability to the synthetic fiber and the subsequent treatment by the natural rubber adhesive can provide excellent bonding strength due to the synthetic rubber adhesive and flexibility for the entire cushioning material, as well as the improvements in the hysteresis loss and permanent compression strain of the cushioning material. Such procedures also improve and increase, on one hand, the insufficient bondability of the natural rubber adhesive to the synthetic fibers by the preliminary deposition of the synthetic rubber adhesive. It is desired that the synthetic rubber latex and the natural rubber latex are applied approximately in identical amounts and the total deposition amounts of them are approximately the same as those of conventional synthetic rubber latex.

Further, as an another embodiment, the adhesive may be applied as shown in FIG. 19 by needling the filament molded body Fb at a needling device 73, spraying an adhesive liquid especially a synthetic rubber or resin adhesive which has high adhesive strength onto a molded body on a conveyer 74 by spraying device 75, and then drying it in a dryer 75' at 80°-200° C., preferably 100°-160° C. for 10-60 minutes, preferably 15-40 minutes. Then the molded body Fb is dipped continuously into an adhesive liquid 77, especially a natural rubber adhesive in a vessel 76, pulled up for approximately vertical direction and dried in a dryer 78 under running at 100°-200° C., preferably 120°-160° C. for 5-60 minutes, preferably 10-40 minutes. Then it is fed to a dryer 80 by a conveyer 79 and dried or vulcanized at 80°-200° C., preferably 100°-160° C. for 10-60 minutes, preferably 15-40 minutes. In the process, the reason why the pre-dryness of the molded body Fb after dipping is carried out by pulling up for approximately vertical direction is to uniform an amount of the adhesive to the body by flowing down the remainder of the adhesive. On the contrary, if the flowing down of the liquid is carried out under running the molded body Fb after dipping, the liquid sometimes adhere much more at a lower portion. Further, the reason why the molded body Fb after needling is previously treated by spraying the adhesive and drying is to give shape holdability to the molded body Fb when it is pulled up for approximately vertical direction.

According to further another embodiment, the cushioning material having large thickness may be obtained by applying the adhesive to the filament molded body after needling and drying it by means of the above mentioned various method, then feeding the drafted three-dimentional crimped filament mass onto the molded body, compression molding the mass to a required bulk density, needling it, applying the adhesive to it and drying. Furthermore, a laminated cushioning material having different bulk density may be obtained by the above method by varying the compression ration, kind of the filament and the like of the subsequently fed filament. In this case, it is preferably that the needling is carried out to entangle between each of the filaments of the lower cushioning material and upper molded body by using a longer needle than the thickness of the molded body.

Description has been made for the cushioning material as having generally uniform degree of entanglement between each of the crimped filaments, that is, having a uniform compression resilience. This method can not, however, produce cushioning material whose surface portion is soft and of a low compression resilience and the inside portion is rigid and of a high load strength. Such cushioning material can be obtained in a cushioning material in which the contact points between each of the drafted three-dimensionally crimped filaments are bonded to each other by the adhesive, wherein filaments crimped in various shapes formed by partially expanding and compressing at required specific portions in desired specific directions only in the filament groups deep inside of the cushioning material are distributed with partially increased degree of the entanglement. The above cushioning material can be produced by the process which comprises opening the drafted three-dimentionally crimped filament mass, molding it into a predetermined configuration, sticking the molded body of the three-dimensionally crimped filament mass thus molded at least from one of the required specific directions along which load strength is intended to be increased using needles each having barbs at its tip and inserted movably in a fine tube by inserting the fine tube into a predetermined depth at required specific portions of the filament body and then projecting and retracting the needle from and into the top of the fine tube, and then bonding the contact points between each of the crimped filament constituting the molded body with the adhesive.

FIGS. 10 and 11 show schematic construction of such needles for the production of the foregoing cushioning material, wherein needles 35 are secured to a fixture 43 which is set with a bolt 44 to the bottom of a needle mount 38 adapted to move vertically by the crank mechanism. Under the needle mount 38, is suspended a slit plate 37 by means of a suspending rod 46 having a coil spring 45 in such a way that a way that the distance can be adjusted. The density of the needles is as has been specified foregoings. To the lower surface of the slit 37, is disposed fine tubes 47 usually pointed at the tip so as to enclose each of the needles 35 upon their elevation and the tubes are secured to a fixture 48, which is set by a bolt 49. The slit plate 37 is regulated by a stopper 50 so as not to lower below a predetermined height so that the tip of the fine tube 47 is not inserted into the filament mass Fb exceeding a predetermined depth. Under the slit plate 37, is disposed a flat plate 36 such as a non-perforation plate, perforated plate and slit plate for supporting the lower surface of the filament mass Fb transported and compression molded on the belt conveyor.

Reference is to be made for the operation of the device. A needle mount 38 is caused to move vertically by a crank mechanism to the filament group Fb transferred and compression molded on the belt conveyor while supporting the lower surface of the mass Fb on the flat plate 36. Then, since the slit plate 37 lower together with the needle mount 38, the needles 35 are lowered while enclosed in the fine tubes 47 into the filament mass Fb to a predetermined depth, that is, to a depth where the slit plate 37 abuts against the stopper 50. Upon further lowering of the needle mount 38, since the slit plate 37 can no more lower abutting against the stopper 50, the needle mount 38 lowers while compressing the coil spring 45 to thereby project the tip of the needles 35 out of the fine tubes 47 and the needles stick only the deep inside of the filament mass Fb. On the contrary, upon elevation, the needles 35 are enclosed in the fine tubes by the resilience of the coil spring 45 when the tip of the needles 35 returns to the predetermined depth.

Thus, by sticking only the deep inside of the predetermined portions of the filament mass Fb by the needles 35, the connection points between each of the filament show more dense distribution in those portions than the others. Such cushioning material can be obtained as well by the sole use of the needle by adjusting the sticking depth of the needle. The bonding treatment is conducted in the same was as in the foregoings.

While description has been made for vertical sticking, horizontal sticking, slantwise sticking and the combination thereof are of course possible. The vertical movement mechanism may be replaced with a cylinder mechanism, cam mechanism, rack mechanism or the like.

Since the cushioning material obtained by the above method is soft in the surface layer (low load strength) and rigid at deep inside (high load strength) and provides desired load strength only at the required specific portions in the required specific directions and, consequently, it can provide the cushioning material with various cushioning properties depending upon the application uses and such cushioning material gives desired results in view of human engineering when used as seats and the likes.

In the cushioning materials produced by the process as described above, compression resilience can partially be varied by the partial changes in the density of the needle distribution whereby the compression resilience can be varied corresponding to the load distribution of a sitter in the cushioning materials for seats and the like. A much more desired cushioning property for seat use can be attained by cushioning material formed by bonding the contact points between each of the filament in the drafted three-dimensionally crimped filament mass by means of the adhesive, wherein (1) the bulk density of the cushioning material is increased and (2) filaments crimped in various shapes formed by partially expanding and compressing the filament crimps with directionality in required specific directions are distributed with partially increased density of entanglement depending on the magnitude of the load exerted on the cushioning material.

The above cushioning material for seat use can be produced by the process comprising (1) supplying a drafted three-dimensionally crimped filament mass into a molding die recessed at a part of its bottom corresponding to the portion of the cushioning material where the bulk density is to be increased, (2) up-turning the die and removing the bottom, (3) compressing the filament group supplied to the die, (4) sticking the mass of the three-dimensionally crimped filament thus molded by needles having barbs at the tip for predetermined number of times in such a way that the portions where the degree of the partial entanglement between each of the various shapes of crimped filaments is to be increased has a increased density and then (5) bonding the contaction points between each of the crimped filaments constituting the above molded block by adhesives.

FIGS. 12 to 14 show each of the machines actuated by a device connected to a computer which arranges and stores various factors for providing desired compression resilience or cushioning property, that is, denier and radius of the crimps of the starting filament material, types and quantity of the adhesives, fiber density and the likes, or the apparatus without using such a computer but controlled and operated by a control device incorporated with information of predetermined conditions.

In FIG. 12, the molding die comprises an outer peripheral wall 51 and a bottom plate 52, which is formed with a recess 53 capable of containing raw material so as to provide a required bulk density at predetermined portions of the molded products produced through compression molding and the die is mounted rotatably to a frame 55 by means of a shaft 54 secured to the outer peripheral wall 51. Three-dimensionally crimped filament 56 of a large denier opened in an opener are supplied under metering or after metering by means of an air blower or like other means. The filament staples 56 may be supplied alone or in admixture with other types of filaments uniformly, or they can be supplied in such a way as each type of the staples forms a layer respectively.

Then, a plate 58 of a desired shape which is connected to an air or hydraulic cylinder 57 is lowered by the cylinder (or mechanical or magnetic means) 57 to cover the filament layer 56 and the die is up-turned so as to place the plate 58 at the bottom. The plate 58 may not always be flat but may rendered uneven so as to provide desired varying bulk density to the molded products. The cylinder 57 and the plate 58 can be constituted detachably from each other upon turning the die, or they can be kept connected upon upturning. Then, the bottom plate 52 now situates above is removed by an air or hydraulic cylinder (or mechanical or magnetic means) (not shown) into the state as shown in FIG. 13 where the filament layer 56 protrudes at a portion corresponding to the foregoing recess 53.

Further, after the removal of the elevated bottom plate 52, the filament layer 56 is compressed by an apertured plate 59 such as perforated plate, slit plate and the like so as to form a desired bulk density in that portion. Then, the protruded portion of the filament layer 56 is intensely compressed particularly and the bulk density thereof is increased by so much. The above compression may be applied to such an extent as to provide bulk density and size just required in the final products, but such an eventual density can alternatively be obtained by the subsequent compression after the needling and the adhesive setting as described later. Upon rotation of a crank shaft 60, a crank 61 is actuated causing a needle mount plate 62 connected thereto to move vertically. This causes needles 63 each having barbs and mounted at a desired pitch to move vertically thereby carrying out needling for the filament layer 56. As the result, crimps in the filaments are partially expanded or compressed in the sticking direction into S-, I-, J-, 3- and corrugated shapes to entangle the three-dimensional crimps in the filament to each other. The degree of the entanglement, that is to say number of entangled portion per unit section, is increased depending on the needle pitch, that is, with the density of the needle mounting. For example, as shown in FIG. 14, needling is conducted with an increased needle density in the middle portion where greater bulk density is required. Required sticking direction, position and sticking cycles in the needling are instructed or controlled by a computer as required. Upon needling, filament entanglement can be achieved at predetermined portions by using needles each having barbs and reciprocally incorporated in a pointed tube, inserting the tube to a predetermined depth and then projecting the needle further into the filament layer.

The molded mass of three-dimensionally crimped filament thus needled is then subjected to the bonding treatment by spraying an adhesive on it in the die or after taking out from the die, or by immersing the same into an adhesive solution and then drying. Where the molded products have been needled at a high needling density in the die and is not easily deformable if taken out of the die, it may be applied with the adhesive after taking out from the die. On the contrary, if it is liable to deform out of the die, the following two methods may preferably be employed. In the first method, a preliminary bonding treatment is effected by spraying a comparatively rapid-drying adhesive, for example, a synthetic rubber adhesive such as SBR, NBR, urethane rubber, etc. polyvinyl chloride, cellulose acetate, vinyl acetate and acrylic adhesives through a needle sprayer about 5–10 mm in diameter to the molded body placed in the die and then drying the same to bond the contact points between each of the filament to such an extent so that no deformation is resulted in the molded body. Then, the bonded body is taken out from the die, applied with a adhesive having elasticity such as polyurethane, natural rubber and synthetic rubber adhesive in an emulsion or a latex solution by way of spraying or immersing, and then dried or vulcanized to obtain final products. In the second method, elastic adhesives are initially sprayed to the molded products using a needle spray and the bonded block is dried or vulcanized by heating the same together with the die or blowing hot air or steam into the die to obtain the final products. It is of course necessary to apply releasing treatment or coat a releasing agent on the surface of the die used herein so as to facilitate mold releasing, as well as to provide holes for inserting hooks or adhesive spraying needles. Further, a metal screen or a perforated die can be used if no particular troubles are resulted in view of the fabrication strength. In addition, three-dimensionally crimped filament staple of different material and physical properties (such as denier and degree of crimp) can further be supplied removing the plate 9 after the foregoing needling and bonding treatments, compressed and subjected again to needling, bonding, etc.

The sprayer described above used herein is shown in FIG. 15 wherein a plurality of double pipes each constituting an outer pipe 64 and an inner pipe 65 both printed at the tops and each formed with at least one aperture 66 and 67 in the vicinity of the top are mounted in plurality to a mounting plate 68. By lowering the mounting plate 68, the needle sprayer is inserted into the molded body and the adhesives injected under pressure from a liquid reservoir 69 and passes through the channel 70 of the outer pipe 64 are sprayed through the aperture 66 when air injected under pressure from an air reservoir 71 and passes through a channel 72 of the inner pipe 65 jets out from the aperture 67. Use of such a particular type needle sprayer can be replaced with conventional sprayers which spray the adhesive onto the molded body from above.

The cusioning material for seat use thus prepared can further be compressed, if required, while blowing steam at a temperature between 80°–110° C., preverably, 90°–105° C. in a desired compression rate, for example, by 10–60%, preferably, 20–40% thereby obtaining cushioning material having generally flat surface and in which the filament density and the degree of the entanglement are increased in the inside in a pattern corresponding to those before the compression.

The bulk density of the seat-like cushioning material in accordance with the present invention, while varying depending on the end uses and desired compression resilience, is usually between 0.005–0.1 g/cm$^3$, preferably, 0.01–0.05 g/cm$^3$ before the bonding treatment and usually between 0.01–0.2 g/cm$^3$, preverably, 0.03–0.12 g/cm$^3$ after the bonding treatment. Accordingly, eventual amount of the adhesive applied is usually between 10–200 g/100 g filament, preferably 50–120 g/100 g filament as a solid content. The needle density is between 1–100 needles/100 cm$^2$, preferably, 4–50 needles/100 cm$^2$. Application of the foregoing steam compression necessarily increase the bulk density by so much.

As foregoings, since the cushioning material for seat use described above is adapted such that the bulk density of the cushioning material is increased and the filament crimped in various shapes formed by partially expanding and compressing the crimps of the filaments with directionality in required specific directions are distributed with partially increased density for the degree of the entanglement depending on the magnitude of the load exerted thereon, desired compression resilience can optionally be got in various portions of the cushioning material used for seat over which the sitter's body weight is unevenly distributed. Further, this cushioning material is very comfortable upon use since it gives a sitter no bottom-touching feeling upon sitting as experienced in conventional polyurethane foam and rubber foam seats and always possesses desired cushioning effects. Still further, according to the process of the present invention, three-dimensionally crimped drafted filament mass is supplied to a die whose bottom is recessed at a part corresponding to the portion of the cushioning material where the bulk density is to be increased, the die is up-turned and the bottom is removed, and the filament groups supplied to the die are compressed. This enables to provide a predetermined bulk density for the entire portion, as well as provide a higher bulk density for the portion of the filament block that protrudes corresponding to the recessed volume in the bottom of the die since this portion is additionally compressed more by so much thereby partially increasing the cushioning property of the material. Further, according to the present invention, the molded body of the three-dimensionally crimped filament thus molded is sticked for predetermined number of times by needles having barbs at the top so that the filaments crimped in various shapes partially increase their degree of entanglement and the contact points between each of the crimped filament constituting the foregoing molded body is bonded with the adhesive. This enables to control the entanglement between each of the filament by the needling density, number of sticking cycles, direction of the sticking and the like whereby desired compression resilience or cushioning property can be attained, as well as the cushioning material for seat use can be mass produced since the production step is very simple.

When compared with carpets manufactured by way of conventional needle punch method, the cushioning material in accordance with the present invention has the following differences.

At first, while the filaments used in this invention is of denier greater than 30 d, the filaments used in the conventional needle punch process is of denier below 20 d.

Secondaly, upon needling (sticking filaments with needles), while the filament mass is distributed thinly enough in the present invention to allow the deflection, filament mass is distributed densely in the needle punch method whereby the deflection is substantially impossible.

Thirdly, while the needling is effected in the present invention by partially sticking only at required specific portions in required specific directions such as vertically, slantwise and traversely to result in densely entangled portions and no entangled portions applied with no such needling, vertical needling is effected by passing through the needles evenly for the entire portion in the needle punch method.

Fourthly, while the three-dimensionally crimped filament is used in the present invention, such filaments are not used in the conventional manufacture of felts and the likes. Further, while the cushioning property may be varied by increasing the density by bonding treatment or the like in the conventional method, modification for the cushioning properties depending on the ways of sticking and entanglement is not effected in the conventional method.

The cushioning material in accordance with the present invention is very excellent in the cushioning properties has a satisfactory air permeability, as well as can provide optional compression resilience in required specific directions. Further, the material is also useful as cushioning material for bed, as well as seat for automobiles and aircrafts.

The present invention is to be described in more detail by way of preferred embodiments.

EXAMPLE 1

Three-dimensionally oriented crimped filament of 7.5 cm length and of 300 denier as a monofilament was supplied, after opening, to a conveyor belt by means of an air blower and compressed to a thickness of 100 mm to obtain a molded filament body. The body had a bulk density of 0.025 g/cm$^3$. The molded body was fed on the conveyor belt and transferred over a slit plate at a speed of 780 mm/min. and needling was effected from above by rotating a crank mechanism and thereby vertically moving at 60 strokes/min. a mounting plate equipped with needles each having barbs and arranged at 2.5 cm pitch in a zig-zag manner in two rows. Then, the molded filament body thus needled was sprayed with adhesive containing 100 parts by weight (50% solid) of natural rubber latex, 2.4 parts by weight of colloidal sulfur dispersion, 6.0 parts by weight of zinc oxide dispersion, 2.4 parts by weight of Noxceller PX dispersion (manufactured by Ouchi Shinko Kagaku Kabushiki Kaisha) and 20 parts by weight of water in an amount of 20–100 g/100 g filament and then heated for 30 minutes at 130° C. to obtain cushioning material. The bulk density of the cushioning material was about 0.05 g/cm$^3$ and the cushioning property was highly satisfactory. The needles used were 1.8 mm in diameter, 91 mm in length and had 6 barbs.

EXAMPLE 2

Polyester filament of 100 denier was needled by needles (1.8 mm dia., 91 mm length and with 6 barbs) arranged in 30 mm pitch vertically for 20, 40, 60 and 80 times (total in up and down strokes) and bonded with adhesives as in Example 1 to obtain cushioning materials A, B, C and D. Polyurethane foam E was also prepared for the comparison. Upon conducting a test according to Japanese Industrial Standard (hereinafter referred to JIS) K 6401 for these specimens (200 mm×200 mm×100 mm) with pressure piece diameter of 200 mm and compression rate of 100 m/min., graphs as shown in FIG. 16 were obtained.

EXAMPLE 3

Upon conducting a similar test for the specimens prepared in a similar manner as in Example 2 but varying denier of the polyester filament and sticking for 40 times in total for up and down sticking strokes under the same conditions as in Example 2, graphs shown in FIG. 17 were obtained, wherein curves F, G, H and I represent the results of the test for the filaments of 100, 200, 300 and 500 denier respectively. Curve J represents the results for polyurethane foam.

EXAMPLE 4

Three-dimensionally oriented crimped 300 denier polyester filament were compression molded to a bulk density of 0.025 g/cm$^3$, needled at a needle density of 9 needles/100 cm$^3$, sprayed with SBR adhesives containing 100 parts by weight (40% solid) of SBR latex, 1–3 parts by weight of a vulcanizing agent, 7–8 parts by weight of a vulcanizing aid, 1–3 parts by weight of a culvanizing accelerator, and 30 parts by weight of water in a deposition amount of 25% to the entire weight and then dried at 130° C. for 20 minutes to perform primary treatment. Then, the above molded body was immersed in a natural rubber adhesive solution containing 100 parts by weight (50% solid) of natural rubber latex, 1–3 parts by weight of sulfur dispersion, 6–7 parts by weight of zinc oxide dispersion, 1–3 parts by weight of Noxceller dispersion and 30 parts by weight of water in a deposition amount 28% to the entire weight and then heated at 130° C. for 30 minutes to obtain a cushioning material. Upon conduction of a test according to JIS K 6401 to the cushioning material, the hysteresis was 35–40% and the permanent compression strain was less than %.

EXAMPLE 5

Three-dimensionally oriented crimped filament of 80 mm length and of 300 denier as a monofilament was untwisted, supplied while metered into a die formed at its bottom with a recess by way of an air blower and covered with a perforated plate. Then, the die was up-turned and the bottom was removed. The filament was further covered with a perforated plate and compressed to an average bulk density of 0.03 g/cm$^3$. Then, needling was effected using needles having barbs at an average needle density of 9 needles/100cm$^2$ (max. 25 needles/100cm$^2$, min. 4 needles/100cm$^2$). Then, the filament mass was sprayed with SBR latex using a needle sprayer, dried, thereafter taken out from the die, immersed in a natural rubber emulsion and then vulcanized at 130° C. for 30 minutes to thereby obtain cushioning material for seat use having compression resilience distribution as shown in FIG. 18. The cushioning material gives a sitter no bottom-touching feeling upon sitting and has an excellent cushioning properties.

What is claimed is:

1. A reinforced cushioning material comprising a compression molded body of drafted three-dimentionally crimped filament mass of a synthetic fiber in which the crimped filaments are of staple length and randomly-oriented and the contact points between each of the filaments are bonded with an adhesive, said body having isolated zones in which the crimped filament is further crimped in situ into various shapes formed by partially expanding and compressing the filament crimps in said zones, and said zones being distributed throughout the reinforced portion of said body, being oriented in the same direction, and having increased density in the degree of entanglement and the number of contact points.

2. A cushioning material according to claim 1, wherein the synthetic fiber filament is of 30–1000 denier.

3. A cushioning material according to claim 1, wherein the three-dimensionally crimped filament of said mass is a three-oriented, three-dimentionally crimped filament formed by untwisting heat-set, double-twisted filament.

4. A cushioning material according to claim 1, wherein the cushioning material has a bulk density between 0.01–0.2 g/cm$^3$.

5. A cushioning material according to claim 1, wherein said zones is between 1–100 zones/100cm$^2$.

6. A cushioning material according to claim 2, wherein the synthetic fiber filament is polyester.

7. A cushioning material according to claim 3, wherein the synthetic fiber filament is of 200–600 denier.

8. A cushioning material according to claim 2, wherein the adhesive is applied in an amount of 10–200 g per 100 g of the filaments as a solid content.

9. A cushioning material according to claim 2, wherein said zones are disposed only at the deep inside of the cushioning material.

10. A cushioning material according to claim 2, wherein said cushioning material has, in the area where the greatest load is exerted thereon, an increased density in the degree of the entanglement and number of contact points.

11. A cushioning material according to claim 10, wherein the cushioning material is for use with seats.

12. A process for the production of a cushioning material and increasing the load strength thereof, which comprises the steps of molding a mass of randomly-oriented, staple, drafted three-dimensionally crimped filament mass of a synthetic fiber into a predetermined configuration, sticking the molded body thus obtained at specific zones oriented in the direction along which the load strength is to be increased for a predetermined number of times by needles having at least one barb at their tips and arranged at a predetermined needle density, whereby said crimped filament mass in said zones has an increased density in the degree of entanglement and the number of contact points, and then bonding the contact points between each of the crimped filament constituting the above molded body by an adhesive.

13. A process according to claim 12, wherein the synthetic fiber filament is of 30–1000 denier.

14. A cushioning material according to claim 12, wherein the three-dimensionally crimped filament of said mass is a three-oriented, thee-dimentionally crimped filament formed by untwisting heat-set, double-twisted filament.

15. A process according to claim 14, wherein the cushioning material has a bulk density between 0.01–0.2 g/cm$^3$.

16. A process according to claim 13, wherein the sticking density is between 1–100 needles/100cm$^2$.

17. A process according to claim 13, wherein the synthetic fiber is polyester.

18. A process according to claim 15, wherein the molded filament body prior to the needling and the adhesion application has a bulk density between 0.008–0.1 g/cm$^3$.

19. A process according to claim 13, wherein the adhesive is applied in an amount of 10–200 g per 100 g of the filament as a solid content.

20. A process according to claim 19, wherein the bonding for the contact points between each of the filaments by the adhesive is effected through drying after the application of the adhesive.

21. A process according to claim 19, wherein the adhesive is applied by means of spraying.

22. A process according to claim 19, wherein the bonding is effected by dipping the molded filament body in the adhesive solution.

23. A process according to claim 19, wherein a synthetic rubber adhesive is applied at first and then a natural rubber adhesive is applied subsequently to the molded filament body.

24. A process according to claim 19, wherein the filament molded body is applied with a rapid-drying adhesive by spraying, dried, dipping into an adhesive liquid having elasticity, pulled upward in an approximately vertical direction and finally dried.

25. A process according to claim 24, wherein the rapid-drying adhesive is a synthetic rubber adhesive and the adhesive having elasticity is a natural rubber adhesive.

26. A process according to claim 12, in which the sticking is effected by inserting a fine tube into said molded body to a predetermined depth and, thereafter, projecting and retracting the needles into and out of said molded body through said fine tube.

27. A process according to claim 12, in which the molding step is effected by (1) supplying the drafted three-dimensionally crimped filament mass into a molding die whose bottom is recessed at a part corresponding to the portion of the cushioning material where load strength is to be increased, (2) up-turning the die and thereafter removing the bottom, and (3) compressing the filament mass in the die (4) then sticking the molded body, and then (5) bonding the contact points.

28. A process according to claim 27, in which the sticking step is effected while said filament mass is compressed.

29. A process according to claim 27, in which the bonding step is effected after the filament mass is molded and compressed into a molded body.

30. A process according to claim 29, in which the sticking is repeated sufficiently for the molded and compressed body to substantially retain its shape after it is removed from the mold and the bonding step is then effected.

31. A process according to claim 29, in which the molded and compressed body is given a preliminary treatment with adhesive while in the mold, sufficient to retain the molded and compressed shape after the molded body is removed from the mold, the molded body is removed, and the bonding step finished.

32. A cushioning material according to claim 10, in which said increased density is due to a larger number of said zones in said area.

33. A cushioning material according to claim 10, in which said increased density is due to an increase in the degree of entanglement in the zones in said area.

34. A cushioning material according to claim 3, in which the increased density in the degree of entanglement and the number of contacts is characteristic of needling effected with needles having barbs at their tips, in which the needles are punched in and out from about 40 to 80 times.

* * * * *

UNITED STATES PATENT AND TRADEMARK OFFICE

CERTIFICATE OF CORRECTION

PATENT NO. : 4,172,174

DATED : October 23, 1979

INVENTOR(S) : Sadaaki Takagi

It is certified that error appears in the above-identified patent and that said Letters Patent are hereby corrected as shown below:

[57] ABSTRACT, lines 1 & 2; "diamentionally" should read -- dimensionally --
Col. 1, line 8; "same. mass of" should read -- same. --
Col. 3, line 4; "filment" should read -- filament --
Col. 3, line 18; "larger" should read -- large --
Col. 5, line 65; "dimentionally" should read -- dimensionally --
Col. 6, line 17; "such a way that a way that the" should read -- such a way that the -- ("a way that" was repeated)
Col. 6, line 59; "was" should read -- way --
Col. 6, line 59; "foregoings." should read -- foregoing. --
Col. 7, line 48; "adhesives," should read -- adhesive, --
Col. 9, line 27; "printed" should read -- pointed --
Col. 9, line 41; "cusioning" should read -- cushioning --
Col. 10, line 48; "Secondaly" should read -- Secondly --
Col. 13, line 40; "thee" should read -- three -- (second occurrence)

Col. 14, line 10; "dipping" should read -- dipped --

Signed and Sealed this

*Twenty-second* Day of *April 1980*

[SEAL]

*Attest:*

SIDNEY A. DIAMOND

*Attesting Officer*

*Commissioner of Patents and Trademarks*